US005416680A

United States Patent [19]

Holmes et al.

[11] Patent Number: 5,416,680

[45] Date of Patent: May 16, 1995

[54] LUMNAIRE HAVING FRONT AND REAR LIGHT SHIELDS

[75] Inventors: Gordon Holmes, Hollywood; Donald M. Sondej, Sr., Sunrise, both of Fla.

[73] Assignee: RLS Lighting, Inc., Hollywood, Fla.

[21] Appl. No.: 276,335

[22] Filed: Jul. 18, 1994

[51] Int. Cl.[6] ..... F21V 7/00

[52] U.S. Cl. ..... 362/282; 362/307; 362/375; 362/265; 362/322; 362/297

[58] Field of Search ..... 362/359, 277, 322, 282, 362/265, 221, 375, 431, 374, 362, 297, 346, 310, 307

[56] References Cited

U.S. PATENT DOCUMENTS

| | | | |
|---|---|---|---|
| 1,449,018 | 3/1923 | Standish | 362/322 |
| 2,619,585 | 11/1952 | Peters | 362/322 |
| 4,220,986 | 9/1980 | Matteo et al. | 362/375 X |
| 4,236,193 | 11/1980 | Brandt | 362/431 X |
| 4,379,321 | 4/1983 | Plemmons et al. | 362/431 X |
| 4,617,612 | 10/1986 | Pritchett | 362/282 X |
| 4,701,832 | 10/1987 | Lasker | 362/297 X |
| 4,796,169 | 1/1989 | Shemitz | 362/322 X |
| 4,943,901 | 7/1990 | Baldwin et al. | 362/277 |
| 5,136,493 | 8/1992 | Straus et al. | 362/431 X |

FOREIGN PATENT DOCUMENTS

| | | | |
|---|---|---|---|
| 2431 | of 1915 | United Kingdom | 362/322 |

*Primary Examiner*—Ira S. Lazarus
*Assistant Examiner*—Thomas M. Sember
*Attorney, Agent, or Firm*—Rockey, Rifkin and Ryther

[57] ABSTRACT

The high output luminaire of the invention is capable of lighting a specific and determinable area defined by front and rear light shields. A reflector is mounted inside of a housing to forwardly direct light from a lamp positioned therein. The housing includes a hinged, waterproof access door having a transparent portion through which light from the lamp is shown. Adjustable front and rear light shields decreases the front and rear beam spread angles to confine the light from the luminaire to a chosen area.

6 Claims, 2 Drawing Sheets

LUMNAIRE HAVING FRONT AND REAR LIGHT SHIELDS

BACKGROUND AND SUMMARY OF THE INVENTION

The present invention relates generally to complete lighting units and, more particularly, to luminaires for lighting a surface area defined by front and rear light shields.

Due to increased demands on people's time, a significant amount of activity must be conducted at night. Accordingly, manufacturers have an incentive to develop useful lighting devices which allow people to work or play at night.

For example, tennis is a sport that many people play indoors or at night. This requires that the large surface area of a tennis court be fully lit to allow the game to be correctly played with maximum enjoyment for the players. Lighting large surfaces areas such as tennis courts unnecessarily illuminates the area surrounding the tennis court thereby interfering with other people's privacy and/or wasting money by requiring more light than is useful.

Accordingly, it is desirable for manufacturers to design a luminaire for lighting only a desired area.

The high output luminaire of the invention is capable of lighting a specific and determinable area defined by front and rear light shields. A lamp is positioned in a reflector which is mounted inside of a housing. The housing is covered by a waterproof access door which has a transparent portion trough which light from the luminaire shines. An adjustable front light shield and a rear light shield decrease the front and rear output beam spread angle to confine the light shown from the luminaire to a chosen area.

DESCRIPTION OF A PREFERRED EMBODIMENT

Figure 1:
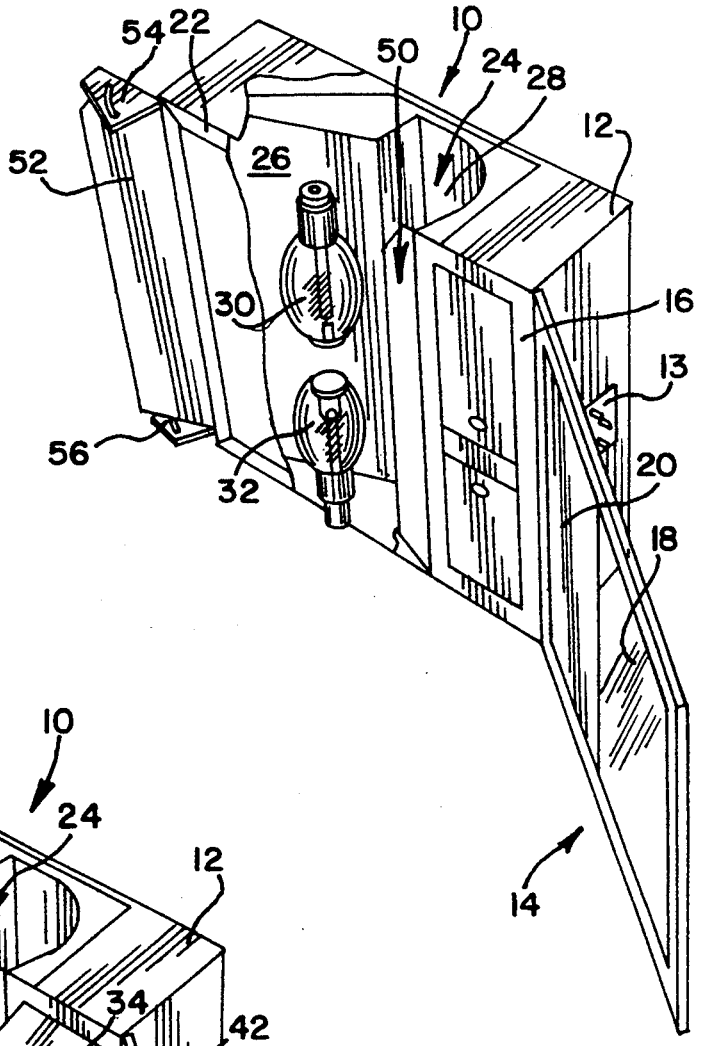
FIG. 1 is a perspective view of the high output luminaire of the invention.

Referring to FIG. 1, a perspective view of the high output luminaire 10 of the invention is illustrated. Luminaire 10 includes an extruded aluminum housing 12 which has a baked on powder coat finish. Preferably, housing 12 is mounted parallel to and above the ground by a mounting pole which is attached to housing 12 by a plurality of nuts and bolts. Access door 14 is connected to housing 12 via hinge 16 and includes an impact resistant tempered glass lens 18 and metal portion 20. A gasket seal (not shown), preferably made of neoprene foam, is provided on access door 14 to seal luminaire 10.

Mounted inside housing 12 is a reflector having an inclined portion 26 and a reflecting chamber 28 both of which are visible through the transparent portion 18 of access door 14. A pair of lamps 30 and 32 are positioned within the reflecting chamber 28 such that light can be directed out of housing 12 by the reflector. A rear shield 50 is attached to and extends from the bottom of the reflector towards the distal end of inclined portion 26. A front shield assembly 47 is attached to the front portion of access door 14 as best shown in FIG. 3.

Figure 2:
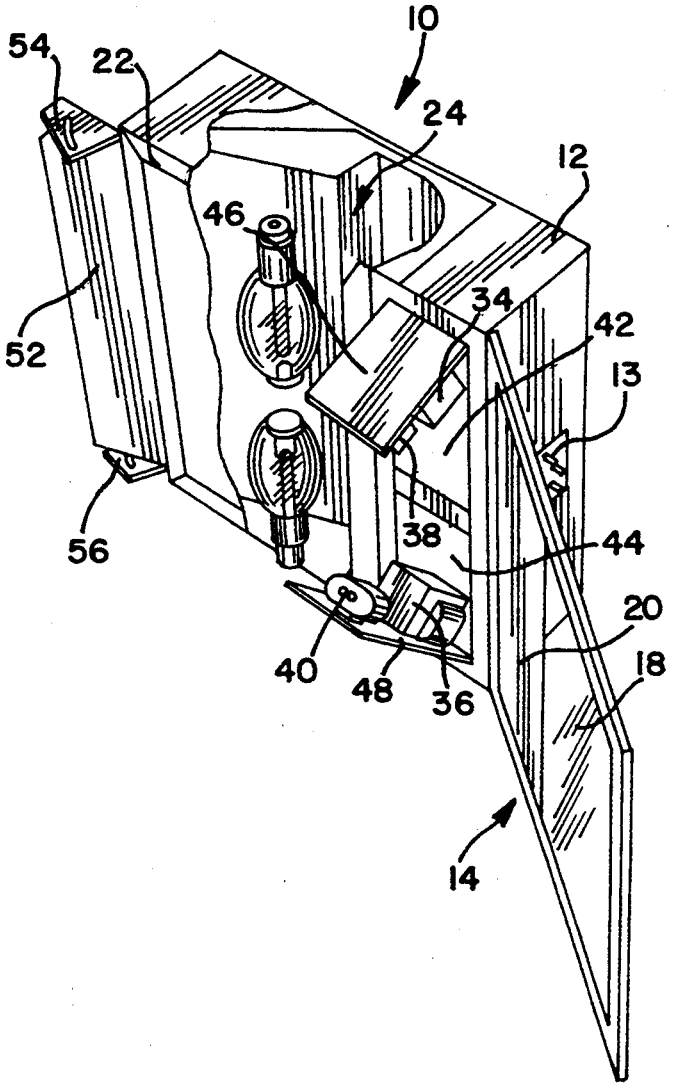
FIG. 2 is a perspective view of the luminaire of FIG. 1 showing the hinged component trays.

FIG. 2 is a perspective view of luminaire 10 which shows the component compartments 42 and 44 located inside housing 12 behind the reflector 26, 28. Access can be gained to compartments 42 and 44 via hinged doors 46 and 48. A transformer and capacitor pair is attached to the inside surface of each door 46 and 48, the pairs being disposed within compartments 42 and 44 when the doors 46 and 48 are closed. The input terminals of the transformers are connected to an external voltage source (not shown) to provide power to luminaire 10. Lamps 30 and 32 are connected to the output terminals of the corresponding transformers and the capacitors provide the correct voltage to lamps 30 and 32.

Figure 3:
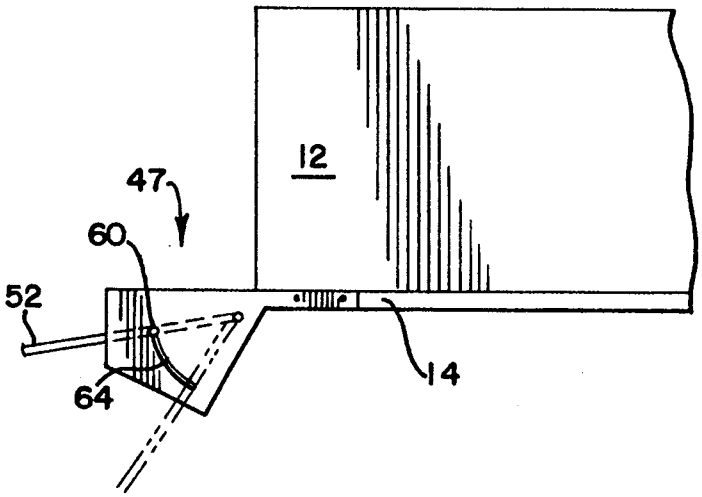
FIG. 3 is an enlarged side view of the luminaire of FIG. 1 showing the adjustable front light shield.

FIG. 3 is a side view of the front portion of luminaire 10 which illustrates the front shield assembly 47. Adjustable front shield 52 is attached to the front of access door 14 by a pair of adjustable mounting brackets 54. Front shield 52 pivots about a horizontal axis defined by a pin 58 in brackets 54.

The angular position of shield 52 about the axis relative to housing 12 is determined by the position of a pair of mounting screws which are disposed in curved channel 64 in each of brackets 54. Thus, shield 52 can be adjustably positioned by tightening the screws at desired positions in the curved channels to adjust the forward beam spread angle as described hereafter.

Figure 4:
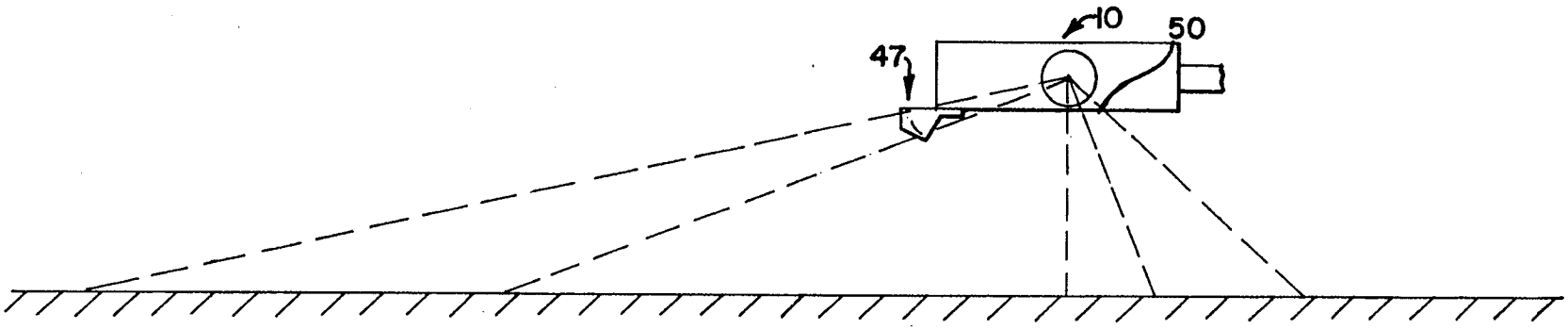
FIG. 4 is a side view of the luminaire of FIG. 1 which illustrates the utility of the front and rear light shields.

FIG. 4 is a side view of luminaire 10 which shows how the front and rear light shields restrict the light output to a specific area. Because rear shield 50 is fixed to the housing 12, it reduces the rear beam spread angle a predetermined amount. However, front shield 52 can be adjustably positioned relative to the housing to reduce the front beam spread angle from a minimum of zero degrees to the maximum afforded by the front shield assembly 47. The minimum and maximum angular positions of shield 52 relative to housing 12 are shown in solid and phantom, respectively in FIG. 3.

The luminaire easily can be positioned above the ground to light a desired area without illuminating the surrounding area. The height at which the luminaire can be mounted above the ground is limited by the maximum distance to the rear from the luminaire which can be illuminated. The maximum height is determined by dividing this distance by the tangent of the rear beam spread angle. The front shield then can be correspondingly adjusted to confine the light shown from the luminaire to a chosen area. The luminaire can be mounted at any height lower than the maximum height as desired.

In the illustrated embodiment, rear shield 50 reduces the rear beam spread angle by 17 degrees and front shield 52 reduces the front beam spread angle from a minimum of zero to a maximum angle of 8 degrees. For example, if luminaire 10 were horizontally mounted 27 feet above ground, then the distance light would be transmitted behind luminaire 10 onto the ground is reduced from 18.5 feet to 8 feet. Also, the distance light would be transmitted forward from luminaire 10 onto the ground is reduced from 100 to 65 feet when the front light shield is at its maximum angular position with respect to the housing 12.

While the invention has been illustrated and described in detail in the drawings and foregoing description, the same is to be considered as illustrative and not restrictive in character, it being understood that only the preferred embodiment has been shown and described and that all changes that come within the spirit of the invention are desired to be protected.

What is claimed is:

1. A high output luminaire comprising:

a) a housing including a reflector;

b) a light source positioned within said reflector;

c) a hinged access door for allowing access to an interior of the housing, said reflector directing light from said light source out of a forward end of the hinged access door;

d) means for adjustably selecting a forward beam spread angle of the light transmitted from the reflector including (i) a bracket having two apertures and two curved channels attached to the forward end of the access door and (ii) a shield having a pair of mounting screws and two pins extending therefrom to define an axis of rotation, said pins being received in said apertures wherein the rotational position of said shield relative to the housing can be adjustably selected by positioning the mounting screws in the curved channels as desired; and e) means for reducing a rear beam spread angle of the light transmitted from the luminaire, whereby a determinable surface area can be lit.

2. The high output luminaire of claim 1 wherein the hinged access door includes a transparent portion of high impact glass at its forward end.

3. The high output luminaire of claim 1 further comprising a pair of component compartments defined within the housing and a corresponding pair of hinged doors for allowing access to the interior of the component compartments.

4. The high output luminaire of claim 1 further comprising means for providing power to said light source.

5. The high output luminaire of claim 4 wherein said means for powering includes a transformer and a coupling capacitor.

6. The high output luminaire of claim 1 wherein said means for reducing the rear beam spread angle comprises an elongated rectangular shield forwardly extending from the reflector.

* * * * *